US010977906B2

(12) United States Patent
Crooks

(10) Patent No.: US 10,977,906 B2
(45) Date of Patent: Apr. 13, 2021

(54) CHECK SHREDDER FOR AN AUTOMATED TELLER MACHINE

(71) Applicant: Diebold Nixdorf, Incorporated, North Canton, OH (US)

(72) Inventor: W. Edward Crooks, Copley, OH (US)

(73) Assignee: Diebold Nixdorf, Incorporated, North Canton, OH (US)

( * ) Notice: Subject to any disclaimer, the term of this patent is extended or adjusted under 35 U.S.C. 154(b) by 461 days.

(21) Appl. No.: 15/912,922

(22) Filed: Mar. 6, 2018

(65) Prior Publication Data

US 2018/0261050 A1 Sep. 13, 2018

Related U.S. Application Data

(60) Provisional application No. 62/468,177, filed on Mar. 7, 2017.

(51) Int. Cl.

| | |
|---|---|
| ***G07F 19/00*** | (2006.01) |
| ***B02C 25/00*** | (2006.01) |
| ***B02C 18/00*** | (2006.01) |

(52) U.S. Cl.

CPC ..... *G07F 19/201* (2013.01); *B02C 18/0007* (2013.01); *B02C 25/00* (2013.01)

(58) Field of Classification Search

CPC .... G06Q 20/1085; G07D 11/00; G07D 11/13; G07D 11/16; G07F 19/00; G07F 19/20

USPC ..... 235/379, 375, 487; 705/35–45; 382/135

See application file for complete search history.

(56) References Cited

U.S. PATENT DOCUMENTS

| | | | | |
|---|---|---|---|---|
| 6,088,119 | A | 7/2000 | Manchala et al. | |
| 6,351,552 | B1 * | 2/2002 | Weaver | G07D 7/0047 382/135 |
| 7,959,072 | B1 | 6/2011 | Jenkins et al. | |
| 2003/0116478 | A1 * | 6/2003 | Laskowski | G07F 19/20 209/534 |
| 2006/0180686 | A1 * | 8/2006 | Podrovitz | G06Q 20/145 241/101.2 |
| 2013/0048715 | A1 * | 2/2013 | Cardinal | E05G 1/024 235/379 |

* cited by examiner

*Primary Examiner* — Edwyn Labaze
(74) *Attorney, Agent, or Firm* — Black, McCuskey, Souers & Arbaugh LPA

(57) ABSTRACT

Described in an example embodiment herein is an apparatus that comprises a safe having first and second openings, a document accepting device located within the safe, a document destruction device located within the safe that is coupled with the document accepting device, and a destroyed document storage device located outside of the safe. The document accepting device is operable to receive a document via the first opening and to forward the document to the document destruction device. The document destruction device is operable to destroy the document; and convey the destroyed document via the second opening the destroyed document storage device.

20 Claims, 6 Drawing Sheets

CHECK SHREDDER FOR AN AUTOMATED TELLER MACHINE

CROSS REFERENCE TO RELATED APPLICATIONS

This application claims the benefit under 35 U.S.C. § 119 of U.S. Provisional Application No. 62/468,177 filed Mar. 7, 2017.

TECHNICAL FIELD

The present disclosure relates generally to handling of deposited documents.

BACKGROUND

Many types of devices are available to receive documents for storage. For example, automated banking machines may receive deposited negotiable instruments such as checks or money orders. The device receiving the deposited item may obtain an image of the negotiable instrument which can be subsequently sent to a remote computer for further processing.

BRIEF DESCRIPTION OF THE DRAWINGS

The accompanying drawings incorporated herein and forming a part of the specification illustrate the example embodiments.

OVERVIEW OF EXAMPLE EMBODIMENTS

Figure 1:
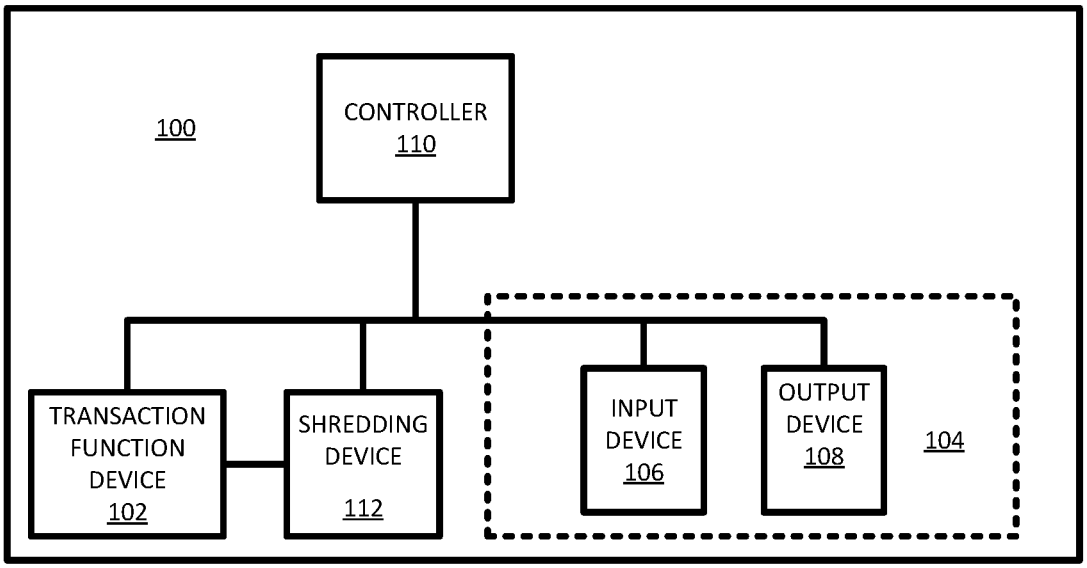
FIG. 1 is a block diagram illustrating an example of an automated banking machine.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein, an apparatus that comprises a safe having first and second openings, a document accepting device located within the safe, a document destruction device located within the safe that is coupled with the document accepting device, and a destroyed document storage device located outside of the safe. The document accepting device is operable to receive a document via the first opening and to forward the document to the document destruction device. The document destruction device is operable to destroy the document; and convey the destroyed document via the second opening the destroyed document storage device.

Description of Example Embodiments

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

FIG. 1 is a block diagram illustrating an example of an automated banking machine 100, such as an automated teller machine or "ATM". The automated banking machine 100 comprises a transaction function device 102 a user interface 104, and a controller 110. The user interface 104 comprises an input device 106 and an output device 108.

The controller 110 is coupled with the transaction function device 102, input device 106, and output device 108. The controller 110 comprises logic for controlling the operation of the automated banking machine 100 and performing the functionality described herein. "Logic", as used herein, includes but is not limited to hardware, firmware, software and/or combinations of each to perform a function(s) or an action(s), and/or to cause a function or action from another component. For example, based on a desired application or need, logic may include a software controlled microprocessor, discrete logic such as an application specific integrated circuit (ASIC), a programmable/programmed logic device, memory device containing instructions, or the like, or combinational logic embodied in hardware. Logic may also be fully embodied as software that performs the desired functionality when executed by a processor.

In an example embodiment, the automated banking machine 100 comprises a document destruction, or shredding, device 112. The document destruction device 112 is coupled to a transaction function device 102, such as, for example, a check acceptor. As will be described in more detail herein, infra, documents are forwarded from the transaction function device 102 to the document destruction device 112 for destruction. In embodiments that comprise a plurality of transaction function devices 102, the document destruction device 112 is coupled with at least one of the plurality of transaction function devices 102. In an example embodiment, the controller 110 is coupled with the document destruction device 112.

Although the document destruction device 112 is described herein is a shredding device, however, those skilled in the art can readily appreciate that any other suitable type of document destruction device, such as a granulator, may be employed as the document destruction device. Thus, the example embodiments described herein should not be construed as limited to shredding device, which was selected merely for ease of illustration.

Figure 2:
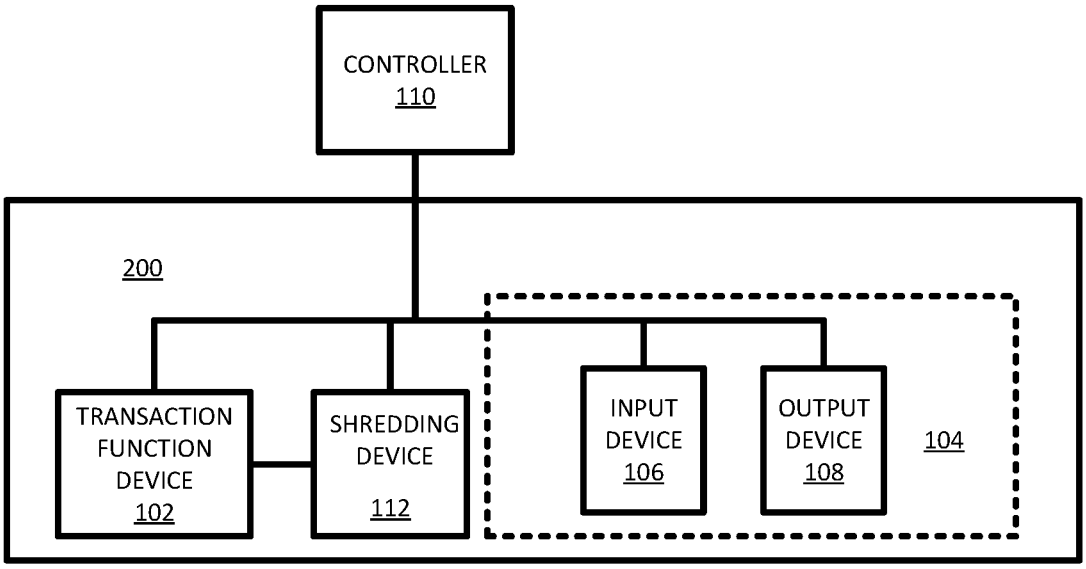
FIG. 2 is a block diagram illustrating an example of an automated banking machine where the controller is located remotely.

FIG. 2 is a block diagram illustrating an example of an automated banking machine 200 where the controller 110 is located remotely. In particular embodiments, the controller 110 may control the operation of a plurality of automated banking machines 200.

Figure 3:
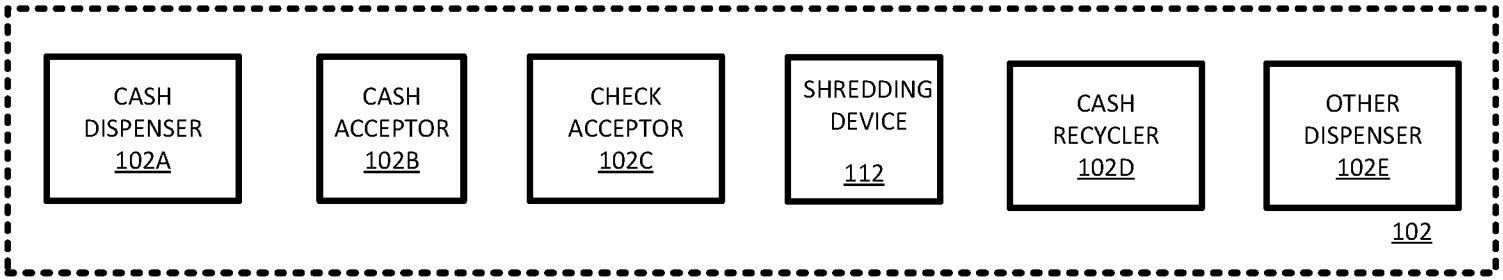
FIG. 3 is block diagram illustrating examples of transaction function devices for an automated banking machine.

FIG. 3 is block diagram illustrating examples of transaction function devices 102 for an automated banking machine 100, 200. In an example embodiment the transaction function device 102 may comprise a cash dispenser 102A. In another example embodiment, the transaction function device 102 may comprise a cash accepter 102B. In yet another example embodiment, the transaction function device 102 may comprise a check accepter 102C. In still yet another example embodiment, the transaction function device 102 may comprise a cash recycler 102D. In an example embodiment, the transaction function device 102 may comprise another type of dispenser 102E. Examples of other types of dispensers include, but are not limited to, check printers, money order printers, or any type of negotiable instrument printer. In other example embodiments, a transaction function device 102 may comprise any combination of the aforementioned transaction function devices 102A, 102B, 102C, 102D, 102E.

Figure 4:
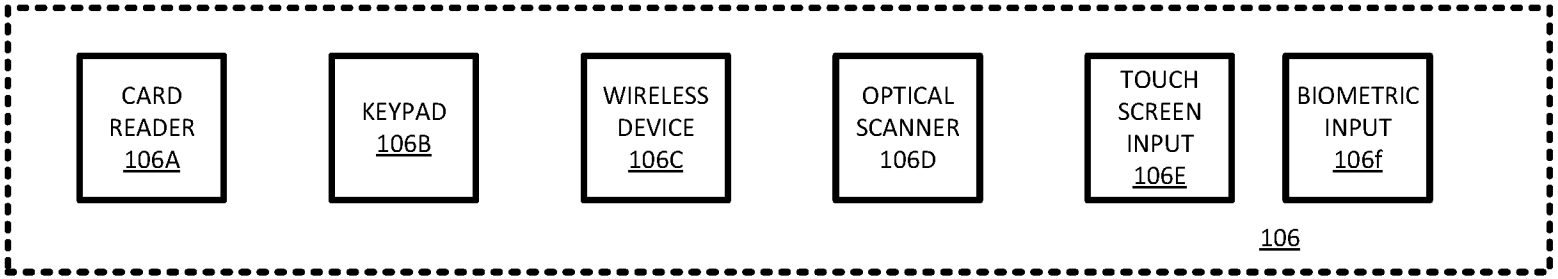
FIG. 4 is block diagram illustrating examples of input devices for an automated banking machine.

FIG. 4 is block diagram illustrating examples of input devices 106 for an automated banking machine 100. 200. In an example embodiment the input device 106 may comprise a card reader 106A. In another example embodiment, the input device 106 may comprise a keypad 106B. In yet another example embodiment, the input device 106 may comprise a wireless (or contactless interface) device 106C. The wireless device 106C may suitably comprise a transceiver suitable to receive any suitable type of wireless protocol, including but not limited to WIFI, BLUETOOTH, Near Field Communication ("NFC"), or multiple transceivers that may be suitable with any combination of the aforementioned protocols. In still yet another example embodiment, the input device 106 may comprise an optical scanner 106D. In particular embodiments, the optical scanner 106D may be a bar code scanner that can read a barcode, such as a Quick Response Code (QR CODE), or both. In an example embodiment, the input device 106 may comprise touch screen input 106E. In other example embodiments, a input device 106 may comprise any combination of the aforementioned input devices 106A, 106B, 106C, 106D, 106E.

Figure 5:
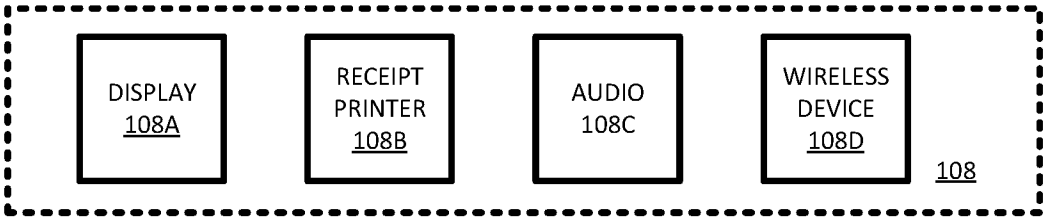
FIG. 5 is block diagram illustrating examples of output devices for an automated banking machine.

FIG. 5 is block diagram illustrating examples of output devices 108 for an automated banking machine 100, 200. In an example embodiment the output device 108 may comprise a display 108A. In particular embodiments, the display 108A may be coupled with a touch screen input 106E (FIG. 4). In another example embodiment, the output device 108 may comprise a receipt printer 108B. In yet another example embodiment, the output device 108 may comprise a wireless device 108C. The wireless device 108C may suitably comprise a transceiver suitable to transmit data via any suitable type of wireless protocol, including but not limited to WIFI, BLUETOOTH, NFC, or multiple transceivers that may be suitable with any combination of the aforementioned protocols. In still yet another example embodiment, the output device 108 may comprise an Audio device 108D. In particular embodiments, the audio device 108D may include a jack (not shown) enabling a user to plug in headphones. In other example embodiments, a output device 108 may comprise any combination of the aforementioned output devices 108A, 108B, 108C, 108D.

Figure 6:
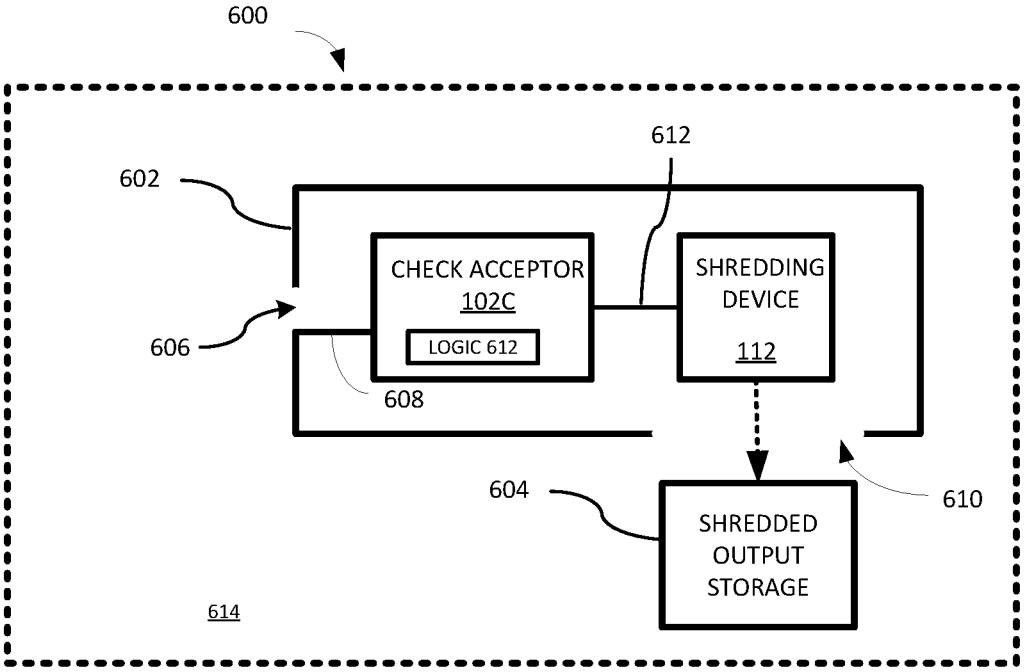
FIG. 6 is block diagram illustrating an example of an apparatus that comprises a check acceptor coupled with a shredding device.

FIG. 6 is block diagram illustrating an example of an apparatus 600 that comprises a document accepting device 102C (a check acceptor in this example) coupled with a document destruction device, which for the illustrated examples herein is a shredding device 112. The check acceptor 102C and shredding device 112 are located inside of a safe 602. A shredded output storage device (e.g., a container which may also be referred to herein as a bin or shredded check storage device) 604 is located outside of the safe 602.

In an example embodiment, a document, such as a check, enters the safe 602 through opening 606 and is conveyed via transport path 608 to the check acceptor 102C. The transport path 608 may employ any suitable technique for conveying the document. For example, the transport path 608 may employ a chute a conveyer belt, a surface with transport belts, vacuum, etc. Those skilled in the art should readily appreciate that besides a check, other types of documents that may be handled include but are not limited to money orders and other negotiable instruments.

Logic 612 in the check acceptor 102C processes the document. For example, the logic 612 may obtain an image of the check. In particular embodiments, the logic 612 may send the image of the check to a remote destination (e.g., a remote host).

Figure 7:
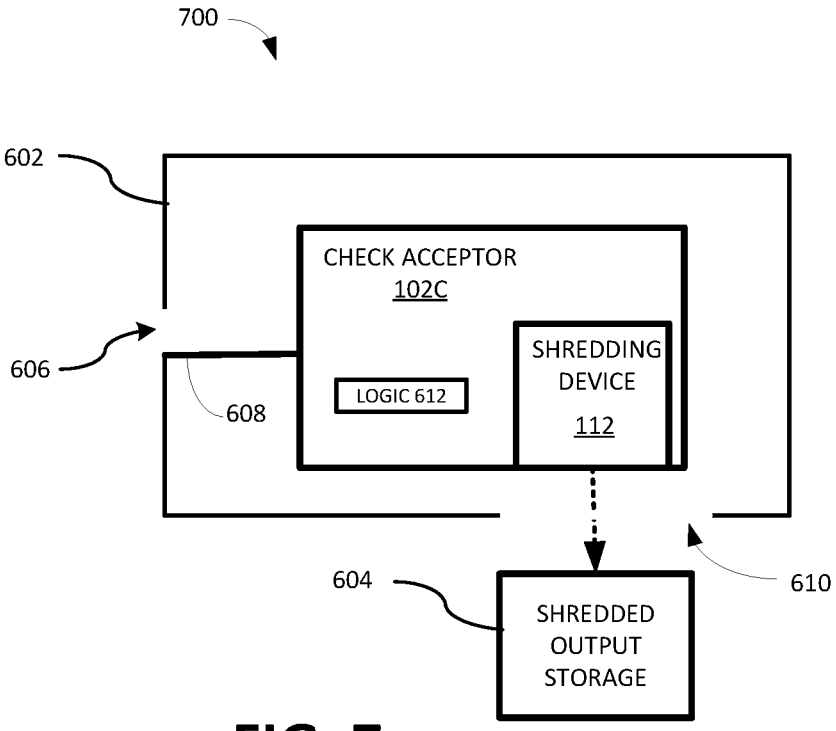
FIG. 7 is a block diagram illustrating an example of an apparatus that comprises a check acceptor with a built-in shredder.

After the check has been processed, the check is forwarded to the shredding device 112. In the illustrated example, the shredding device 112 is located remotely from the check acceptor 102C, however, in other embodiments, the shredding device may be a component of the check acceptor 102C, see e.g., FIG. 7 that illustrates an apparatus 700 where the shredding device 112 is be a component of the check acceptor 102C.

In the example illustrated in FIG. 6, the check is conveyed from the check acceptor 102C to the shredding device 112 via transport path 612. The output from the shredding device 112, e.g., the destroyed document or check, is conveyed via a (in this example a second) opening 610 in the safe 602 to the shredded output storage 604 that is located outside the safe. In an example embodiment, the shredded output storage 604 is located underneath the shredding device 112 and gravity conveys the output of the shredding device 112 to the shredded output storage.

In an example embodiment, the shredded output storage may be located within a secure area 614 that is less secure than the safe 602. For example, certain service personnel may be granted access to the secure area 614 that would not be granted access to the safe 602. This can allow certain personnel access to the shredded output storage 604 to empty the shredded output storage 604 without necessitating a service call to personnel with access to more restricted area, such as the interior of the safe 602. In other embodiments, the shredded output storage 604 may be located in an unsecure area, allowing non-service personnel to empty the shredded output storage 604.

Figure 8:
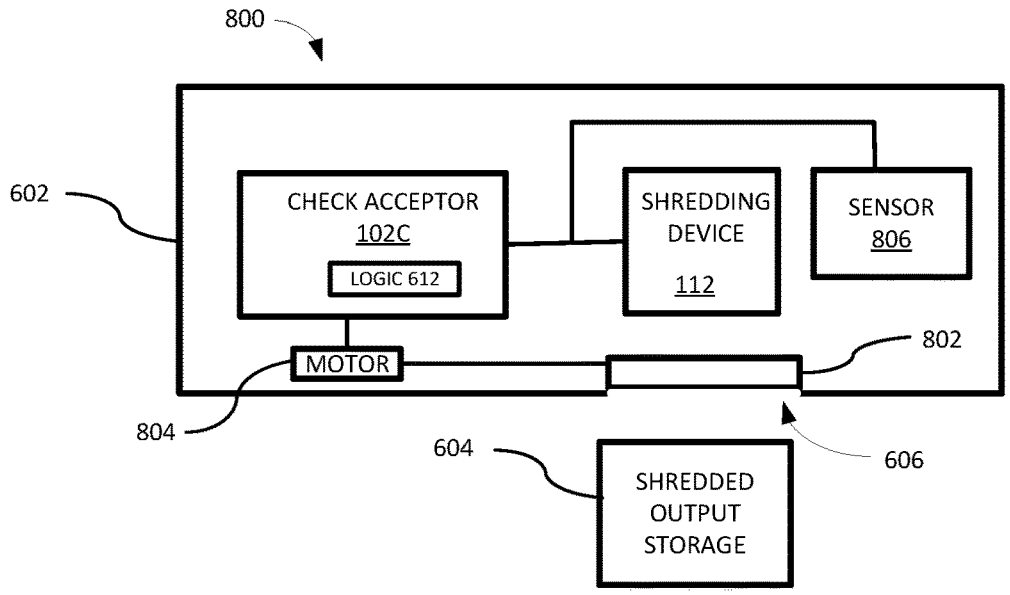
FIG. 8 is a block diagram illustrating an example of an apparatus that comprises a check acceptor coupled with a shredding device with a gate at the opening between the shredding device and the shredded output storage.

FIG. 8 is a block diagram illustrating an example of an apparatus 800 that comprises a check acceptor 102C coupled with a shredding device 112 with a gate 802 at the opening 606 between the shredding device 112 and the shredded output storage 604. The gate 802 may be operable to move between a first and second position, where while in the first position, the gate 802 blocks the opening 606, and while in the second position the gate 802 does not block the opening 606, allowing output from the shredding device 112 to be conveyed to the shredded output storage 604.

In particular embodiments, the gate 802 is coupled with a motor 804. The logic 612 is operable to control the operation of the motor 804 to move the gate 802 between the first and second positions. This can prevent access to the interior of the safe 602 while the shredding device 112 is not in use.

In an example embodiment, an additional sensor (or sensors) 806 such as motion and/or infra red ("IR") sensors (not shown) can be employed to ensure nobody is within a predefined proximity of the automated banking machine while the gate 802 is opened. If a person is detected within the predefined proximity (e.g., 6 feet), shredding may be paused and the gate can be closed to prevent access into the interior of the safe 602 via opening 606.

Figure 9:
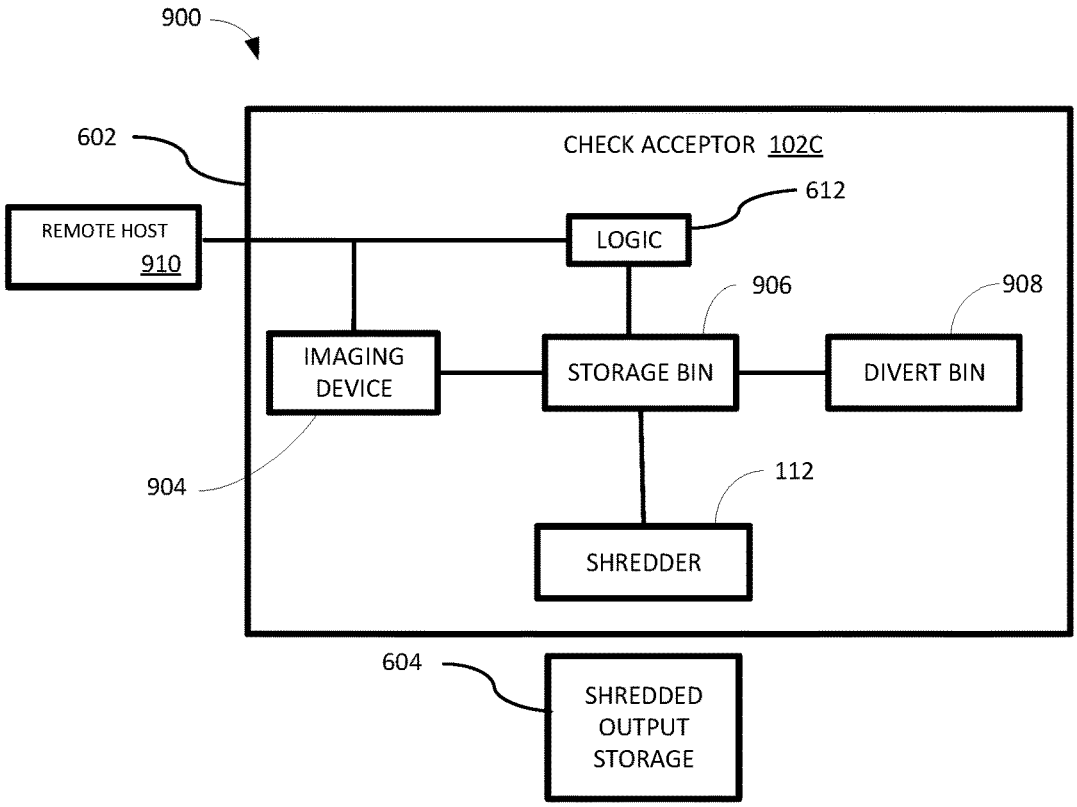
FIG. 9 is a block diagram illustrating an example of an apparatus that comprises a check acceptor coupled with an imaging device, storage bin, divert bin, and a shredder.

FIG. 9 is a block diagram illustrating an example of an apparatus 900 that comprises a check acceptor 102C coupled with an imaging device 904, storage bin (e.g., a check storage device) 906, divert bin 908, and a check shredder (or check shredder device) 112. Upon receipt of a check by check acceptor 102C, the logic (check acceptor logic) 612 associated with check acceptor 102C causes the check to be conveyed to the imaging device 904. The imaging device 904 is operable to obtain an image of the check. The logic 612 associated with check acceptor 102C forwards the document to the check shredder 112 after the imaging device 904 obtains the image of the check.

In an example embodiment, the check acceptor 102C further comprises a document storage device (storage bin) 906. The check acceptor logic 612 is operable to store the check in the storage bin 906. In an example embodiment, the check is stored for at least a predetermined amount of time before forwarding the check to the check shredder 112.

In an example embodiment, the check acceptor 102C further comprises a divert storage device (or divert bin) 908. The divert bin may be employed to hold checks that are not to be destroyed. For example, law enforcement may put a hold on a check for forensic testing if the check is associated with a crime or a victim of a crime.

In an example embodiment, a plurality of checks are stored in the storage bin 906. The check acceptor logic 612 is operable to divert a predefined check selected from the plurality of checks to the divert bin 906. The remainder of the plurality of documents may be forwarded to the shredder 112.

In an example embodiment, the check acceptor logic 612 is operable send the image obtained by the imaging device 904 to a remote host 910. The check acceptor logic 612 is operable to verify that the image of the check was received by the remote host 910 prior to sending the check to the check shredder 112.

In an example embodiment, the check acceptor logic 612 is operable at periodic or aperiodic intervals to review checks stored in the storage bin 906. Alternatively, the check acceptor logic 612 may review checks stored in storage bin 906 at a predefined time of day (or the next free interval near the time of day when the automated banking machine associated with the apparatus 900 is idle. If a check is to be preserved, it is moved to the divert bin 908. If a check has not been stored at least a predetermined amount of time, it is returned to the storage bin 906. If the check has been stored more the predetermined amount of time and is not to be preserved, the check is forwarded to the check shredder 112. Once the check is shredded, the shredded check is forwarded to the shredded output storage 604 located outside of the safe 602.

Figure 10:
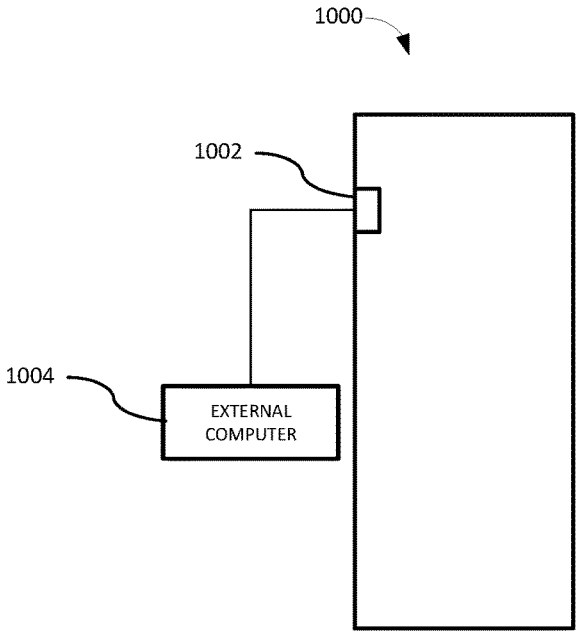
FIG. 10 is a block diagram illustrating an example of a shredded output storage container with a level sensor.

FIG. 10 is a block diagram illustrating an example of a shredded output storage container 1000 with a level sensor 1002. The level sensor 1002 is coupled with a remote (external) computer 1004. The sensor 1002 is operable to cause an alert to be sent to the remote computer 1004 responsive to determining the amount of contents in the destroyed contents storage device exceeds a predetermined threshold. In other words, the sensor 1002 causes an alert to be sent when the container should be emptied.

Figure 11:
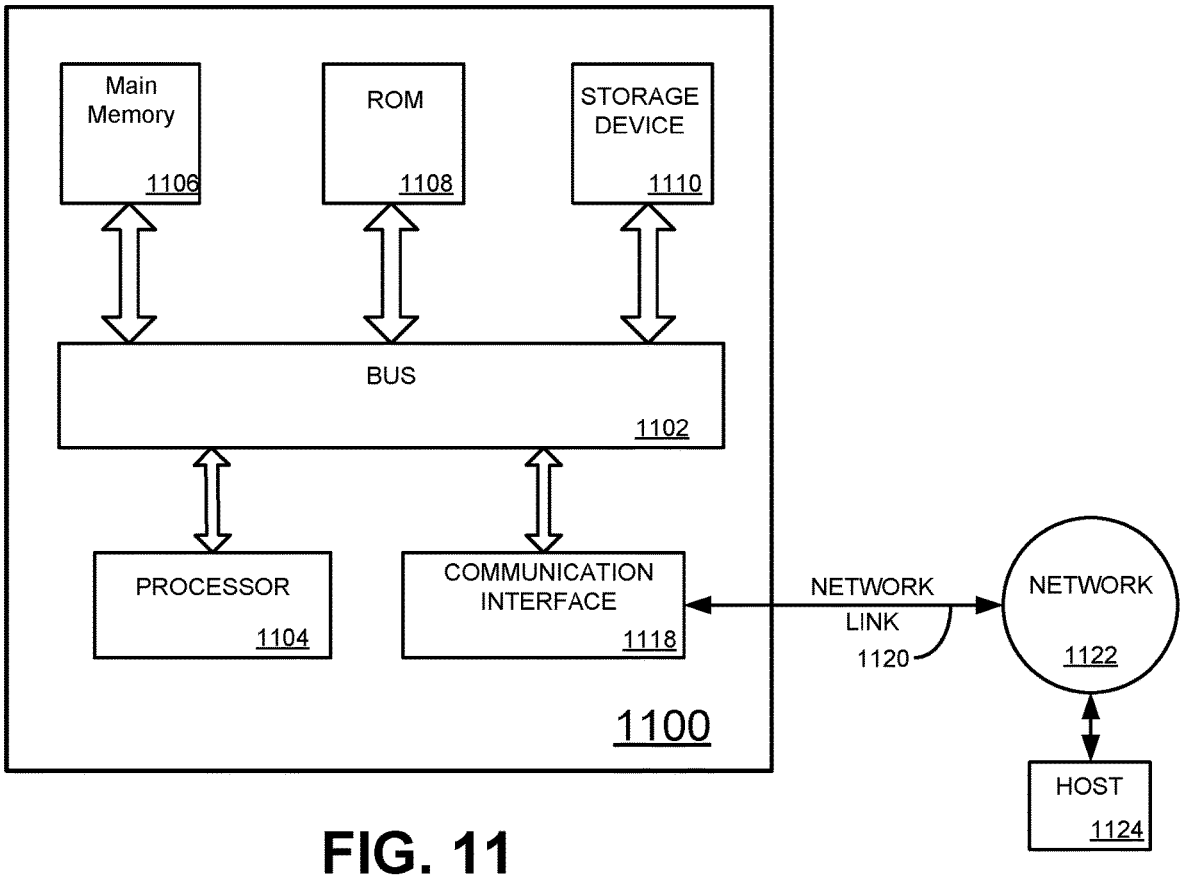
FIG. 11 is a block diagram of a computer system upon which an example embodiment can be implemented.

FIG. 11 is a block diagram of a computer system 1100 upon which an example embodiment can be implemented. Computer system 1100 can be employed to implement the functionality of logic 612 described in FIGS. 6-9.

Computer system 1100 includes a bus 1102 or other communication mechanism for communicating information and a processor 1104 coupled with bus 1102 for processing information. Computer system 1100 also includes a main memory 1106, such as random access memory (RAM) or other dynamic storage device coupled to bus 1102 for storing information and instructions to be executed by processor 1104. Main memory 1106 also may be used for storing a temporary variable or other intermediate information during execution of instructions to be executed by processor 1104. Computer system 1100 further includes a read only memory (ROM) 1108 or other static storage device coupled to bus 1102 for storing static information and instructions for processor 1104. A storage device 1110, such as a magnetic disk, optical disk, and/or flash storage, is provided and coupled to bus 1102 for storing information and instructions.

An aspect of the example embodiment is related to the use of computer system 1100 for implementing a check acceptor with a check shredder for an automated banking machine. According to an example embodiment, implementing a check acceptor with a check shredder is provided by computer system 1100 in response to processor 1104 executing one or more sequences of one or more instructions contained in main memory 1106. Such instructions may be read into main memory 1106 from another computer-readable medium, such as storage device 1110. Execution of the sequence of instructions contained in main memory 1106 causes processor 1104 to perform the process steps described herein. One or more processors in a multi-processing arrangement may also be employed to execute the sequences of instructions contained in main memory 1106. In alternative embodiments, hard-wired circuitry may be used in place of or in combination with software instructions to implement an example embodiment. Thus, embodiments described herein are not limited to any specific combination of hardware circuitry and software.

The term "computer-readable medium" as used herein refers to any medium that participates in providing instructions to processor 1104 for execution. Such a medium may take many forms such as non-volatile media. Non-volatile media include for example optical or magnetic disks, such as storage device 1110. As used herein, tangible media may include any non-transitory media. Common forms of computer-readable media include for example floppy disk, a flexible disk, hard disk, magnetic cards, paper tape, any other physical medium with patterns of holes, a RAM, a PROM, an EPROM, a FLASHPROM, CD, DVD or any other memory chip or cartridge, or any other medium from which a computer can read.

The computer system 1100 also includes a communication interface 1118 coupled to bus 1102. Communication interface 1118 provides a two-way data communication coupling computer system 1100 to a network link 1120 that is connected to a network 1122. For example, communication interface 1118 may be a local area network (LAN) card to provide a data communication connection to a compatible LAN. As another example, communication interface 1118 may be an integrated service digital network (ISDN) card or a modem to provide a data communication connection to a corresponding type of telephone line. Wireless links may also be implemented. In any such implementation, communication interface 1118 sends and receives electrical, electromagnetic, or optical signals that carry digital data streams representing various types of information.

Network link 1120 provides data communication through one or more networks to other data devices. For example, network link 1120 may provide a connection through local network 1122 to a host computer 1124. For example, network link 1120 can allow logic 612 (FIG. 6-9) to receive message indicating documents/checks that should be retained in the divert bin 908 (FIG. 9). As another example, network link 1120 can allow sensor 1002 (FIG. 10) to provide data to a remote computer to allow the remote computer to determine when the container holding the shredded/destroyed documents/checks should be emptied.

Figure 12:
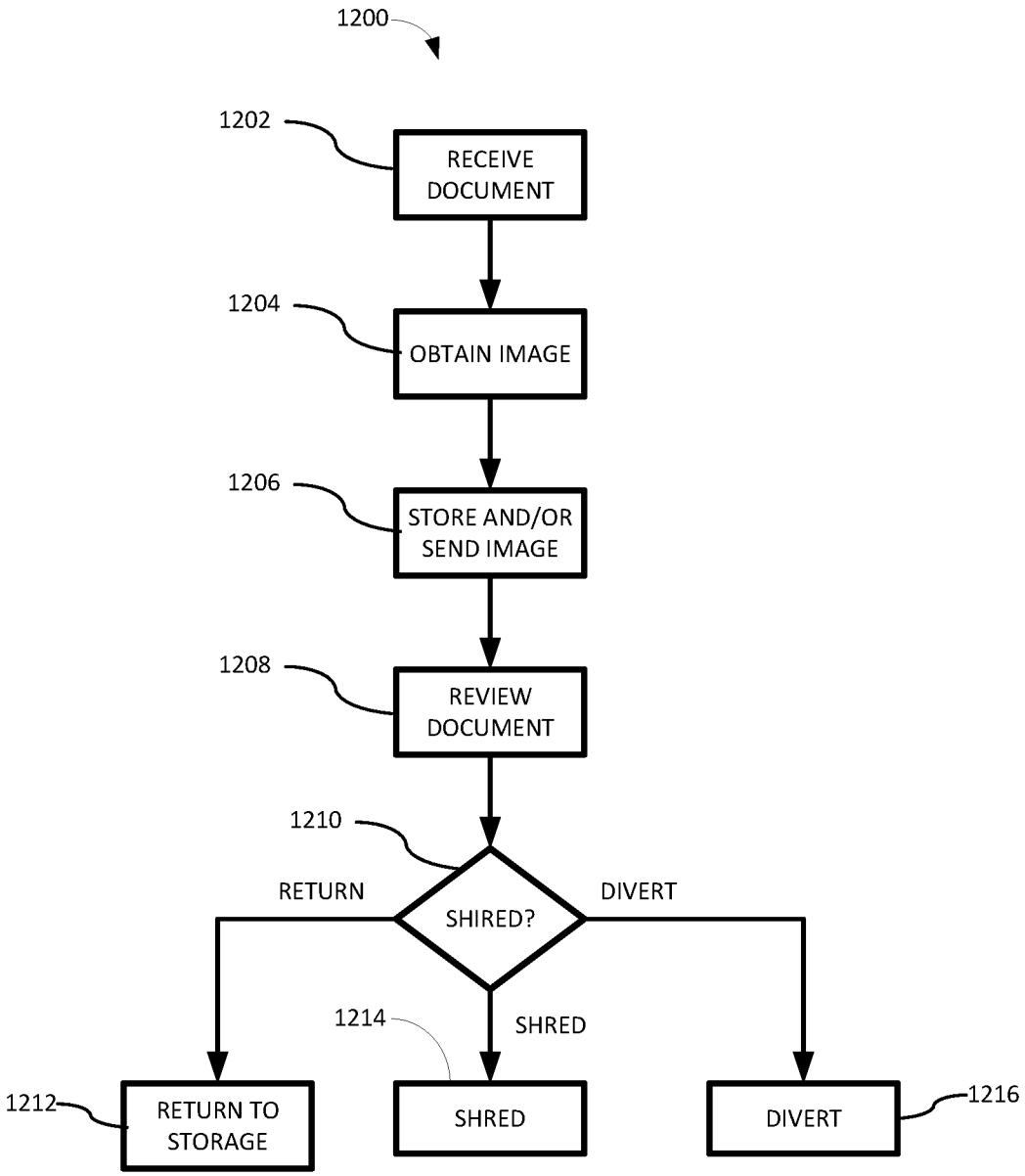
FIG. 12 is a block diagram illustrating an example of a methodology for processing documents.

In view of the foregoing structural and functional features described above, a methodology in accordance with an example embodiment will be better appreciated with reference to FIG. 12. While, for purposes of simplicity of explanation, the methodology 1200 of FIG. 12 is shown and described as executing serially, it is to be understood and appreciated that the example embodiment is not limited by the illustrated order, as some aspects could occur in different orders and/or concurrently with other aspects from that shown and described herein. Moreover, not all illustrated features may be required to implement a methodology 1200 in accordance with an example embodiment. The methodology 1200 described herein is suitably adapted to be implemented in hardware, software when executed by a processor, or a combination thereof. For example, methodology 1200 may be implemented by logic 612 (FIGS. 6-9 and/or processor 1104 (FIG. 11).

At 1202, a document is received by the document acceptor (e.g., check acceptor). The document can be a negotiable instrument such as a check or money order.

At 1204, an image of the document is obtained. The image may be obtained by a camera or a plurality of cameras which may obtain images of one or both sides of the document.

At 1206, the image is either stored, sent to a remote computer (host), or both stored and sent to a remote computer. In an example embodiment, the images may be saved and sent as a batch file at a predetermined time (e.g., once daily).

At 1208, the document is reviewed. The review may determine how long the document has been stored, has there been a hold requested for the document, or whether there is some other reason the document should not be destroyed (e.g., checks above a threshold amount).

At 1210, a decision is made on how to handle the document. For example, should the document be destroyed (e.g., shredded, atomized, granulated, etc.), or retained.

If at 1210, the decision is made that the document should be returned to storage (RETURNED), the document is returned to storage as indicated by 1212. A document may be returned to storage if the document has not been retained for a sufficient time period and/or an image of the document has not been forwarded to a remote host.

If, at 1210, the document is ok to be shredded (SHRED), the document is forwarded to a shredder as indicated by 1214. Note that although the present example uses shredding to destroy the document, any other suitable means may be employed to destroy the document. The shredded output can be deposited in a container outside the safe as described herein supra.

If, at 1210, the document is to be retained (DIVERT), the document is moved to a divert storage area (e.g., a divert bin or container) as indicated by 1216. The divert bin can be located inside the safe or another secure area so that only authorized personnel can access the diverted document.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a safe having first and second openings;

a document accepting device located within the safe;

a document destruction device located within the safe that is coupled with the document accepting device; and a destroyed document storage device located outside of the safe;

the document accepting device is operable to receive a document via the first opening, the document accepting device comprises check acceptor logic and a document storage device;

the document accepting device is operable to forward the document to the document destruction device;

the document destruction device is operable to destroy the document; and the destroyed document is conveyed via the second opening from the document destruction device to the destroyed document storage device;

the check acceptor logic is operable to store the document in the document storage device for a predetermined amount of time before forwarding the document to the document destruction device.

2. The apparatus set forth in claim 1, the document accepting device further comprises an imaging device;

the imaging device is operable to obtain an image of the document; and the document accepting device forwards the document to the document destruction device after the imaging device obtains the image of the document.

3. The apparatus set forth in claim 1, the document accepting device further comprises a divert storage device;

wherein a plurality of documents are stored in the document storage device; and the check acceptor logic is operable to divert a selected from the plurality of documents to the divert storage device.

4. The apparatus set forth in claim 1, wherein the check acceptor logic is operable send the image to a remote host; and the check acceptor logic is operable to verify that the image was received by the host prior to sending the document to the document destruction device.

5. The apparatus set forth in claim 1, wherein the document destruction device is located remotely from the document accepting device, the apparatus further comprising a transport path coupling the document accepting device with the document destruction device.

6. The apparatus set forth in claim 1, the destroyed document storage device comprises a sensor for sensing an amount of contents within the destroyed document storage device, the sensor is coupled with a remote computer; and the sensor is operable to cause an alert to be sent to the remote computer responsive to determining the amount of contents in the destroyed contents storage device exceeds a predetermined threshold.

7. The apparatus set forth in claim 1, further comprising a gate located at the first opening;

wherein in a first position the gate blocks the opening; and wherein the gate being in a second position allows destroyed documents to be conveyed from the document destruction device to the destroyed document storage device.

8. The apparatus set forth in claim 7, further comprising:

check acceptor logic; and a motor coupled with the gate and the check acceptor logic;

wherein the check acceptor logic is operable to operate the motor to cause the gate to move between the first and second positions.

9. The apparatus set forth in claim 1, wherein the document is a negotiable instrument.

10. The apparatus set forth in claim 9, wherein the document is a check.

11. The apparatus set forth in claim 9, wherein the document is a money order.

12. An apparatus, comprising:

a safe an opening;

a check acceptor located within the safe, the check acceptor further comprises check acceptor logic and a check storage device;

a check shredder located within the safe that is coupled with the check acceptor; and a shredded check storage device located outside of the safe;

the check acceptor is operable to receive a check;

the check acceptor is operable to forward the check to the check shredder;

the check shredder is operable to shred the check; and the shredded check is conveyed via the opening from the check shredder to the shredded check storage device;

the check acceptor logic is operable to store the document in the check storage device for a predetermined amount of time before forwarding the document to the check shredder.

13. The apparatus set forth in claim 12, the check acceptor further comprises an imaging device;

the imaging device is operable to obtain an image of the check; and the check acceptor forwards the document to the check shredder after the imaging device obtains the image of the check.

14. The apparatus set forth in claim 13, the shredded check storage device comprises a sensor for sensing an amount of contents within the shredded check storage device, the sensor is coupled with a remote computer; and the sensor is operable to cause an alert to be sent to the remote computer responsive to determining the amount of contents in the destroyed contents storage device exceeds a predetermined threshold.

15. The apparatus set forth in claim 13, further comprising a gate located at the opening;

wherein in a first position the gate blocks the opening; and wherein the gate being at a second position allows shredded checks to be conveyed from the check shredder to the shredded check storage device.

16. The apparatus set forth in claim 15, further comprising:

check acceptor logic; and a motor coupled with the gate and the check acceptor logic;

wherein the check acceptor logic is operable to operate the motor to cause the gate to move between the first and second positions.

17. The apparatus set forth in claim 12, the check acceptor further comprises a divert storage device;

wherein a plurality of checks are stored in the check storage device; and the check acceptor logic is operable to divert a predefined check selected from the plurality of checks to the divert storage device.

18. The apparatus set forth in claim 12, wherein the check acceptor logic is operable send the image to a remote host; and the check acceptor logic is operable to verify that the image was received by the host prior to sending checks to the check shredder device.

19. A method comprising:

receiving a plurality of documents by a document accepting device located within a secure area;

storing the plurality of documents within the secure area;

forwarding a document selected from the plurality of documents to a document destruction device located within the secure area after the document has been stored for a predetermined amount of time; and conveying the document from the document destruction device to a destroyed document storage device that is located outside of the secure area.

20. The method set forth in claim 19, further comprising diverting a selected second document from the plurality of documents to a divert storage device located within the secure storage area.

* * * * *